US006430901B1

(12) United States Patent
Domansky et al.

(10) Patent No.: US 6,430,901 B1
(45) Date of Patent: Aug. 13, 2002

(54) METHOD AND DEVICE FOR OPENING AND FILLING PRE-MANUFACTURED BAG PACKAGES

(76) Inventors: Philippe Domansky, 23, rue du Colombier, 36000 Chateauroux (FR); Meinhard Protz, Holunderstrasse 3, D-29699 Bomlitz (DE)

( * ) Notice: Subject to any disclaimer, the term of this patent is extended or adjusted under 35 U.S.C. 154(b) by 0 days.

(21) Appl. No.: 09/787,305

(22) PCT Filed: Sep. 16, 1999

(86) PCT No.: PCT/EP99/06874

§ 371 (c)(1),
(2), (4) Date: Jun. 7, 2001

(87) PCT Pub. No.: WO00/15501

PCT Pub. Date: Mar. 23, 2000

(30) Foreign Application Priority Data

Sep. 16, 1998 (DE) ..... 198 42 362

(51) Int. Cl.[7] ..... B65B 43/26

(52) U.S. Cl. ..... 53/492; 53/459; 53/457; 53/468; 53/386.1; 53/578; 53/564; 493/313

(58) Field of Search ..... 53/459, 457, 492, 53/468, 570, 564, 386.1, 578; 493/313

(56) References Cited

U.S. PATENT DOCUMENTS 2,281,516 A 4/1942 Royal
2,932,142 A 4/1960 Sindzinski
3,812,649 A * 5/1974 Clancy ..... 53/187
3,832,824 A * 9/1974 Burrell ..... 53/22 B
4,027,456 A * 6/1977 Wilson ..... 53/22
4,232,504 A * 11/1980 Dieterlen et al. ..... 53/570
4,583,347 A * 4/1986 Nielsen ..... 53/434
5,035,103 A * 7/1991 Akkala ..... 53/434

FOREIGN PATENT DOCUMENTS

DE 44 35 294 6/1995
EP 0 844 179 5/1998

* cited by examiner

*Primary Examiner*—Rinaldi I. Rada
*Assistant Examiner*—Thanh K. Truong
(74) *Attorney, Agent, or Firm*—Leonard J. Santisi

(57) ABSTRACT

A method for opening prefabricated pouches for the subsequent filling thereof with each pouch having a circumferential seal and an opening zone comprising holding a pouch on a support and introducing the support with the pouch into a vacuum chamber which has a first opening facing the opening zone of the pouch connected to the environment and a second opening remote from the opening zone, suctioning air from the vacuum chamber through the second opening with a volume flow adequate to produce a vacuum to open the pouch and moving the support with the opened pouch out of the vacuum chamber and apparatus therefor.

19 Claims, 3 Drawing Sheets

METHOD AND DEVICE FOR OPENING AND FILLING PRE-MANUFACTURED BAG PACKAGES

BACKGROUND OF THE INVENTION

The invention relates to a method and an apparatus for opening prefabricated (tubular) pouches, as well as to a method and an apparatus for filling prefabricated (tubular) pouches, which includes a method and an apparatus for opening such pouches.

For numerous reasons, e.g. relating to material and cost saving, as well as environmental considerations, nowadays efforts are often made to replace the hitherto widely used tin cans by pouches, which can be manufactured with a much smaller use of material.

The reason why such pouches have only been used with hesitation and substantially only when the quantities to be packed are very small is that the handling of prefabricated pouches, whilst maintaining a specific shape (dimensional stability) encounters difficulties, which more particularly applies to the opening step, which precedes filling and sealing.

In a prior art installation, the opening of prefabricated pouches in planar form, which are generally rectangular and have a circumferential seal and an opening zone, has taken place in that a pouch is gripped by grippers at its two lateral edges adjacent to the opening zone and movement towards one another takes place by a certain extent so that the pouch can be opened.

This method is disadvantageous in two respects. On the one hand the opening of a pouch by moving together the lateral edges is only possible with relatively small dimensions, because otherwise the pouch would merely sag without opening, and on the other, due to the elasticity of the sealing seams, the pouch can only be opened to a relatively limited extent, which leads to a correspondingly small, maximum filling quantity.

EP-0 844 179 discloses a method and an apparatus for opening prefabricated pouches, wherein opening of the pouches is realized by use of vacuum chambers being formed by two separable half-shells and presenting, when in the closed state, at an upper face an opening having an edge on which the opened pouch engages. The pouches are held by stationary rails covering the opening of the upper face. This known apparatus is used for opening and filling only of bags being able to stand alone in any upright position, not for pouches. Pouches require a special holding means.

Therefore the problem of the present invention is to provide a method and an apparatus for opening prefabricated pouches, with which the aforementioned disadvantages can be overcome and without limitation large pouches can be reliably opened and in particular more widely opened than was the case in the prior art.

SUMMARY OF THE INVENTION

From the method standpoint, this problem is solved by a method for the opening of prefabricated pouches, in which each pouch has a circumferential seal and an opening zone, with the steps: a) holding a pouch on a support; b) introducing the support with the pouch into a vacuum chamber, which has a first opening facing the opening zone of the pouch and which is connected to the environment, as well as a second opening remote from the opening zone; c) sucking air out of the vacuum chamber through the second opening, with a volume flow adequate for producing in the vacuum chamber a vacuum with respect to the environment, through which the pouch is opened; d) moving the support with the pouch held thereon out of the vacuum chamber.

Through the planned use of a vacuum and an air flow directed onto the pouch opening zone, the pouch is reliably and completely opened.

Preferably, the pouch is held on at least one first lateral edge. Appropriately, the pouch is displaceably held on a lateral edge facing the first lateral edge, so that opening is not impeded. The support preferably has a shell-like shape, which unilaterally corresponds to a completely opened pouch.

The vacuum chamber can be formed from two separable half-shells, which receive the support between them. Appropriately, the vacuum chamber is substantially cylindrical.

The first opening can be located in a first face of the vacuum chamber. The second opening can be located in a face opposite the first face.

Preferably, the arrangement is such that the opening pouch engages on the edge of the first opening and substantially closes the latter. Thus, due to the continuous suction of air through the second opening, an increasing vacuum is built up, which largely expands the pouch counter to the inherent elasticity or plastic deformability of the sealing seams.

The invention also relates to a method for filling prefabricated pouches, in which the pouches are opened, filled and closed, the method being characterized by an inventive method for opening prefabricated pouches.

From the apparatus standpoint, the set problem is solved by an apparatus for opening prefabricated pouches, in which each pouch has a circumferential seal and an opening zone, with a) at least one support for holding a pouch, b) a vacuum chamber for receiving the support, which has a first opening facing the opening zone of the pouch and is connected to the environment, and a second opening remote from the opening zone and c) a suction device connected to the second opening.

Preferably, the support has a first, fixed clamping device for the fixed holding of a pouch on a first lateral edge. Appropriately, the support has a second, movable clamping device for the movable holding of the pouch on a second lateral edge.

The support can have a shell-like shape, which unilaterally corresponds to a completely opened pouch.

The vacuum chamber is appropriately formed from a first and a second half-shell, which are separable from one another and receive the support between them. The vacuum chamber is appropriately substantially cylindrical. The first opening can be located in a first face of the vacuum chamber. The second opening can be located on a second face, which faces the first face.

Preferably, the arrangement is such that the opening pouch engages on the edge of the first opening and substantially closes the latter.

At least one support and at least one first half-shell of the vacuum chamber can be fitted to a first, rotating conveyor and at least one second half-shell to a second, rotating conveyor, the first and second conveyors running adjacent to one another within an opening area, so that within said opening area in each case one first half-shell and one second half-shell form a vacuum chamber.

The invention also relates to an apparatus for filling prefabricated pouches, with a filling device for filling empty pouches, a sealing device for sealing pouches, a removal device for removing filled pouches and a feed device for feeding empty pouches, characterized by an inventive apparatus for opening prefabricated pouches.

BRIEF DESCRIPTION OF THE DRAWINGS

The invention is described in greater detail hereinafter relative to an embodiment and the attached drawings, wherein show.

DESCRIPTION OF THE PREFERRED EMBODIMENT

Figure 1:
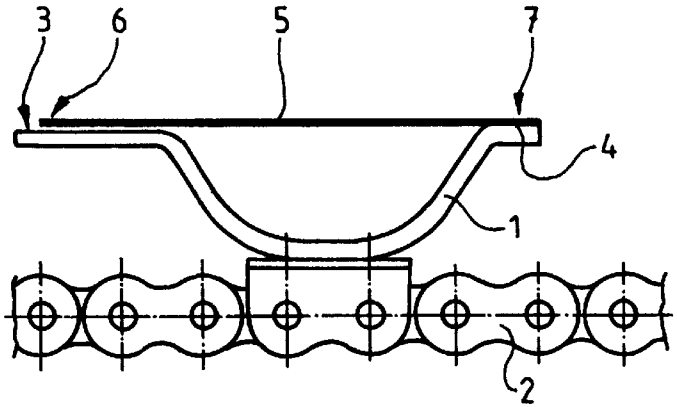
FIG. 1 A plan view from above of a support fitted to a conveyor and having a pouch held thereon (in the closed state).

The method according to the invention for opening prefabricated pouches will firstly be explained relative to FIGS. 1 to 4. FIG. 1 shows in a plan view of a support 1, which is fixed to an edge 2, which can in particular be part of a rotating conveyor and to said edge can be fixed in mutually spaced manner a large number of further, identical supports. In cross-section or plan view, the support 1 is shell-like or trough-shaped with two bearing surfaces 3 and 4 located in one plane. A prefabricated pouch 5 in planar form, is held in fixed manner in the bearing surface 4 and in displaceable manner against the bearing surface 3 by means of not shown clamping or gripping means.

In its simplest form, the pouch 5 is rectangular and has an overall U-shape, circumferential seal, whilst leaving free an opening zone, so that after opening and filling, the pouch can be closed by sealing the opening zone. In a further developed construction, the pouch 5 is provided with a bottom fold, which makes it possible to place filled pouches on a planar substrate, e.g. a shelf base.

Figure 2:
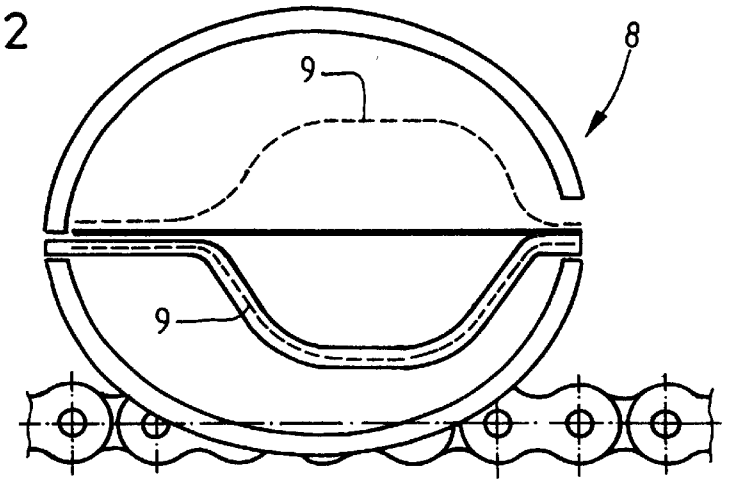
FIG. 2 A view corresponding to FIG. 1, in which a two-part vacuum chamber surrounds the support.

In known manner, the pouch material can be plastic, metallized plastic, a composite material of two or more paper, plastic and/or metal foils, etc. FIG. 2 shows a vacuum chamber 8, which is arranged around the support 1 with the pouch held thereon. The vacuum chamber 8 appropriately comprises at least two parts, which engage in half-shell-like manner around the support 1. For example, one jointing plane can be located substantially in the plane of the pouch 5, or perpendicular thereto, i.e. substantially in the presentation plane of FIG. 2.

As is further indicated in FIG. 2, the substantially cylindrical vacuum chamber 8 is provided on its upper (above the presentation plane of FIG. 2) face with an opening 9, whose boundary line substantially corresponds to the cross-sectional shape of the support 1, or is correspondingly supplemented on the opposite side of the pouch 5, seen from the support 1.

Figure 6:
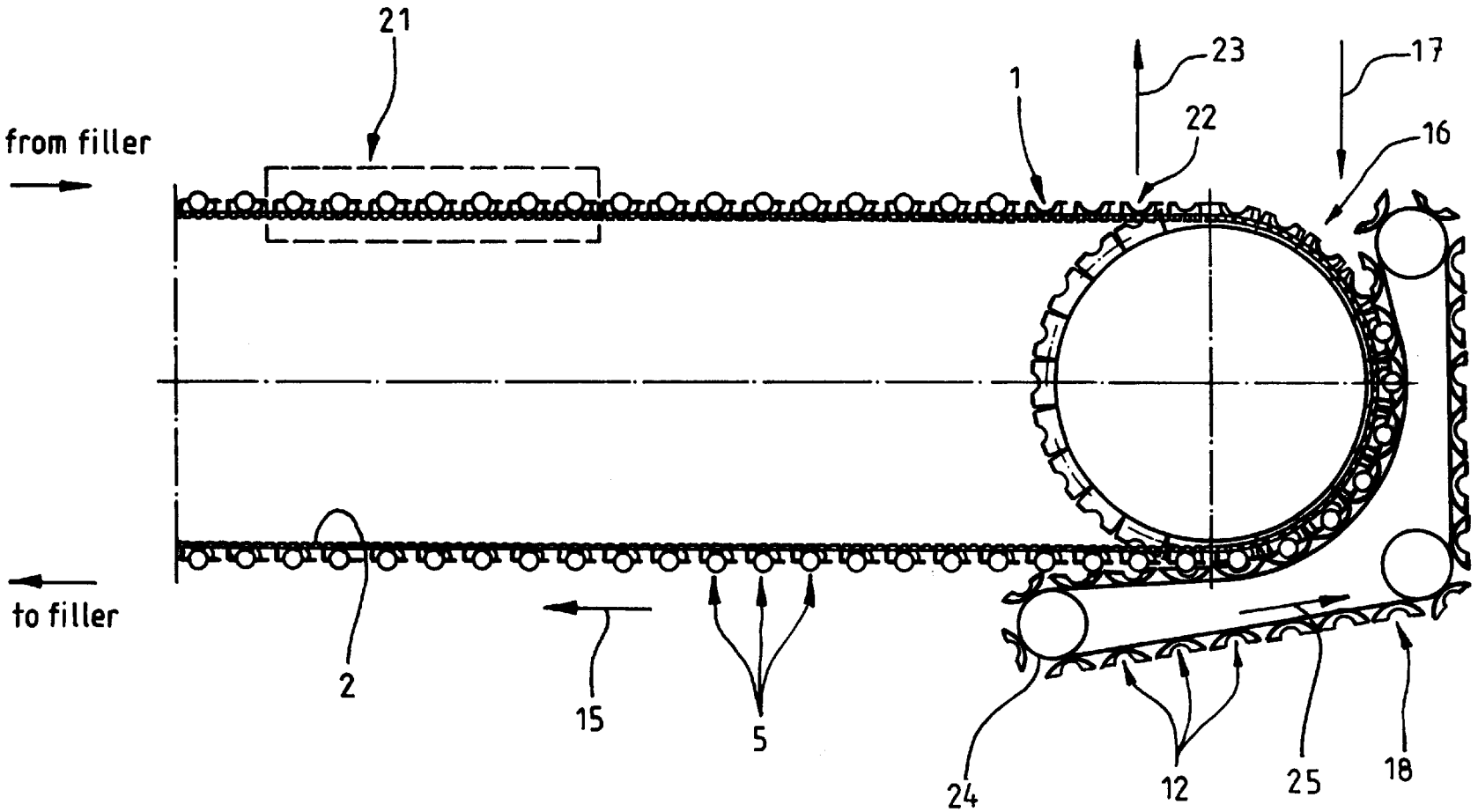
FIG. 6. A diagrammatic view of a filling and sealing installation for pouches.

FIG. 6 serves to further illustrate the vacuum chamber 8, which in this case comprises two vertically split half-shells 12, 13, between which is received the support 1 for the not shown pouch.

Figure 3:
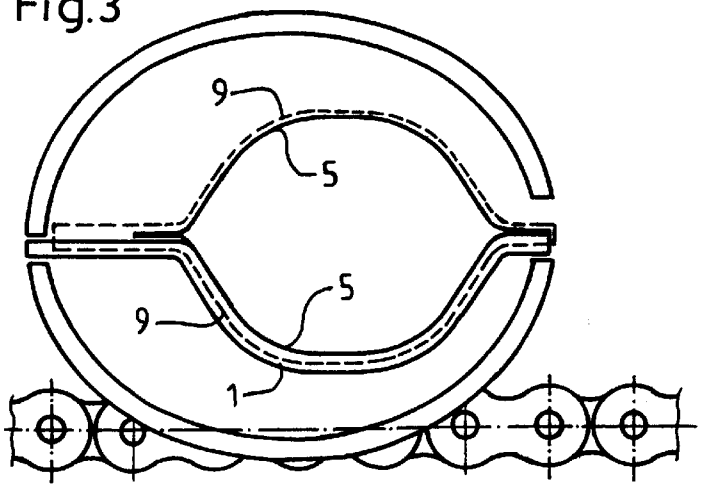
FIG. 3 A view corresponding to FIG. 2 with the pouch open.
Figure 5:
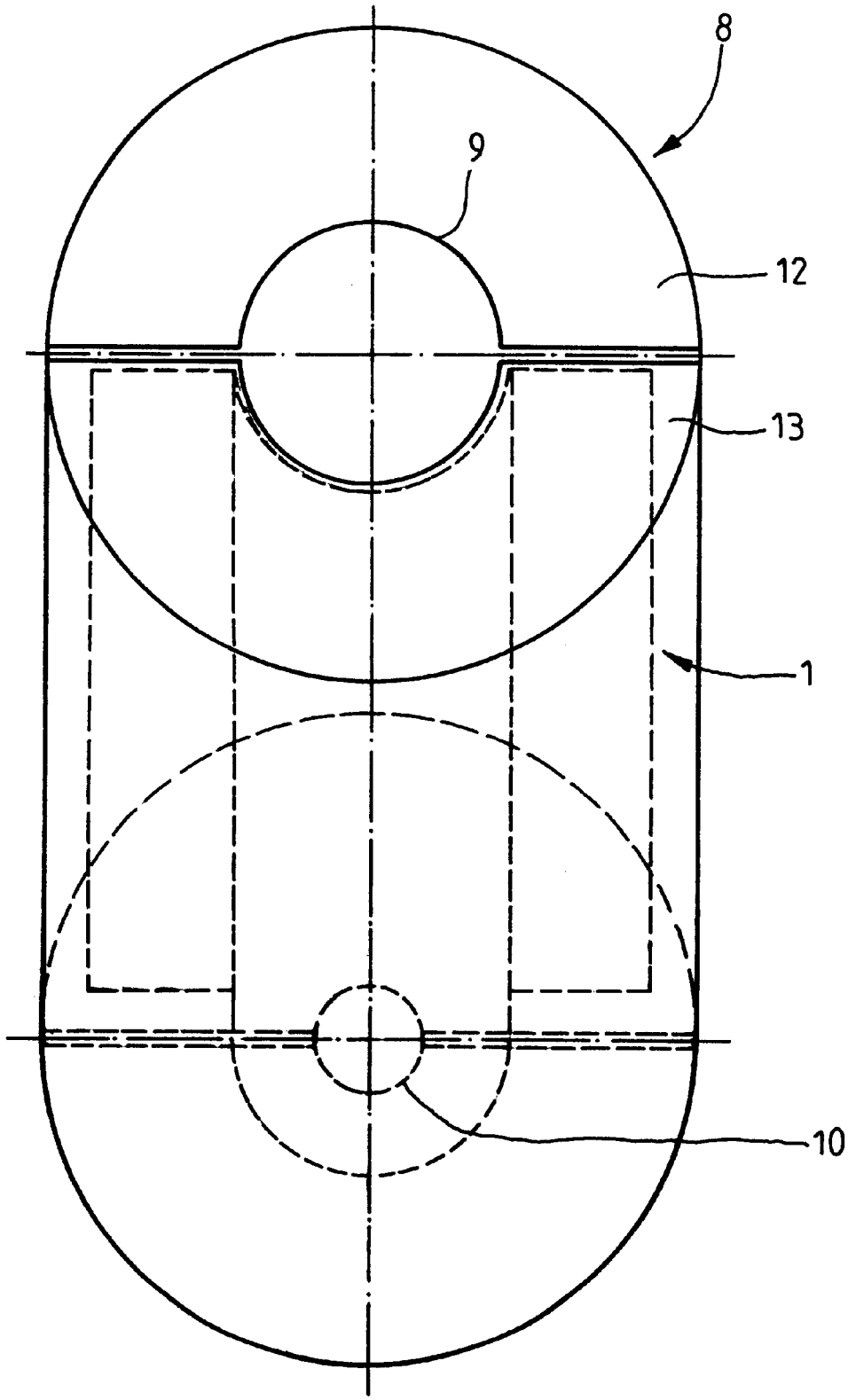
FIG. 5 A diagrammatic view of a filling and sealing installation for pouches.

FIG. 3 is a view corresponding to FIG. 2, the pouch 5 being completely opened. It can be seen that the first, held fixed lateral edge 7 of the pouch has maintained its position unchanged, whereas the second lateral edge 6 has moved in the direction of the first lateral edge, in order to compensate the opening or stretching of the pouch. As can also be seen in FIG. 3, one half of the pouch 5 has been applied in full surface manner to the correspondingly shaped support 1 and on the other side, as is clear from the perspective view of FIG. 6, with its upper edge it engages largely against the edge of the first opening 9. As is visible from FIG. 6, the two half-shells 12, 13 of the vacuum chamber 8 form a second opening 10 facing the first opening 9.

Figure 4:
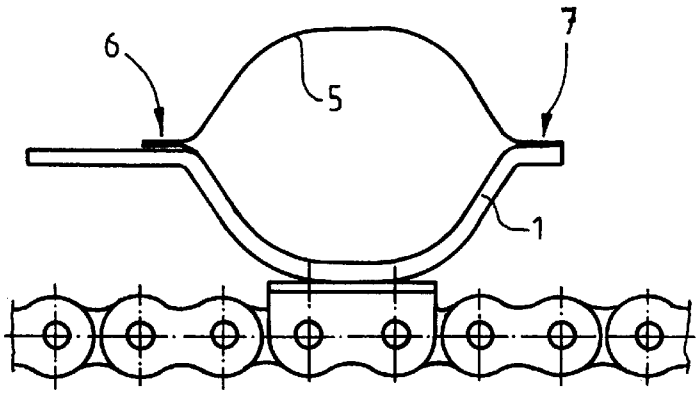
FIG. 4 A view corresponding to FIG. 1 with the pouch open.

Finally, FIG. 4 shows a view corresponding to FIG. 1, in which the two half-shells 12, 13 of the vacuum chamber 8 have been removed again or moved apart and the pouch 5 assumes its open, stretched form, assisted by the mounting support of its two lateral edges 6, 7 on the corresponding bearing surfaces of the support 1.

The function of the apparatus according to the invention will now be explained. On reaching the state shown in FIG. 2, i.e. after the vacuum chamber 8 has closed round the pouch 5 held on the support 1, a vacuum source or suction device is connected to the lower or second opening 10, which faces the opening zone of the pouch. As a result of the air flow resistance through the first opening 9 into the vacuum chamber, a slight vacuum forms therein, whilst an inflow corresponding to the suction takes place through the opening 9, i.e. meeting the still closed edge of the pouch in the vicinity of the opening zone.

The cooperation of a slight vacuum on the lateral faces of the pouch and an air flow encountering the opening zone leads to a gradual pouch opening. This opening movement continues in accelerated form, because the first opening 9, through which the ambient air flows into the vacuum chamber 8, is increasingly closed due to the increased opening of the pouch. Finally the end state shown in FIG. 3 is reached, in which the upper edge of the pouch 5 engages substantially against the edge of the first opening 9 in the vicinity of its opening zone and consequently the free flow cross-section for ambient air flowing into the vacuum chamber 8 has been very significantly reduced. As a result of the continuing suction from the second opening 10, as from this point, i.e. as from the application of the upper edge of the pouch to the first opening 9, an increasing vacuum occurs within the vacuum chamber 8. As a result of this vacuum, the pouch 5 is expanded to the extent possible without destroying the circumferential seal in the area of the lateral and bottom edges. The first, movably held lateral edge 6 of the pouch moves in the direction of the second, held fixed lateral edge 7 to the degree necessary for expansion.

The pronounced expansion of the pouch has the advantage that on the one hand a maximum capacity is achieved, i.e. a given pouch can be filled with a maximum filling quantity and as a result of a certain plastic deformation in the sealing area, said expanded shape is maintained automatically for a certain time, i.e. at least up to the following filling process. FIG. 6 shows in a diagrammatic plan view a detail of an installation for opening, filling and closing (sealing) prefabricated pouches, the opening process being performed in accordance with the invention. The installation has a continuous conveyor 2, to which a plurality of supports 1 is fitted at regular intervals. The conveyor 2 rotating continuously in the direction of the arrow 15 receives at its feed station 16 prefabricated pouches entering in the direction of the arrow 17, which have come either from a corresponding stock or directly from a pouch manufacturing machine, whereupon they are opened at an opening station 18. The opened pouches 5, which are in each case held on a support 1, pass to a not shown filling station and then to a merely intimated sealing station 21, where the opening zone or upper edge of the pouch is sealed. The filled and sealed pouches are finally delivered to a discharge station 22 in the direction of arrow 23.

The opening station 18 is so inventively constructed that over a certain running length a vacuum chamber is formed around each individually supplied pouch. For this purpose a second conveyor 24 is provided, which within an opening area runs very close to the first conveyor 2, the movement direction and speed of the engaging areas coinciding (arrow 25). The second conveyor 24 is provided at regular intervals with half-shells 12, which cooperate with corresponding half-shells 13, which are not individually represented in FIG. 6 and which are fitted to the conveyor 2, so that within the area in which the conveyor 24 runs immediately adjacent to the conveyor 2, vacuum chambers 8 are formed, as is intimated in FIG. 5. In addition, the lower opening 10 of the vacuum chamber 8 formed by the two half-shells 12, 13 is linked within the opening area in an appropriate manner to a vacuum source or a suction device, so that the pouch opening process explained hereinbefore relative to FIGS. 1 to 5 is carried out. At the end of the opening area 18, the conveyor 2 consequently carries completely opened pouches 5, which are in each case held on supports 1.

The method according to the invention and the apparatus, as indicated in FIG. 6, makes possible a continuous processing of pouches at high speed, the individual pouches being rapidly, reliably and completely opened.

The features of the invention disclosed in the preceding description, drawings and claims can both individually and in random combination be essential to the implementation of the different embodiments of the invention.

LIST OF REFERENCE NUMERALS

1 Support
2 (First) conveyor
3/4 Bearing surface
5 (Tubular) pouch
6 First lateral edge
7 Second lateral edge
8 Vacuum chamber
9 First opening
10 Second opening
12 First) half-shell
13 (Second) half-shell
15 Arrow
16 Feed station
17 Arrow
18 Opening station
20 Filling station
21 Sealing station
22 Discharge station
23 Arrow
24 Second conveyor
25 Arrow

What is claimed is:

1. A method for opening prefabricated pouches having a circumferential seal and an opening zone for the subsequent filling thereof comprising the steps of:

a. holding a pouch on a support member;

b. introducing the support member with the pouch into a vacuum chamber which has a first opening, which faces the opening zone of the pouch and is connected to the environment, and a second opening remote from the opening zone, c. suctioning air from the vacuum chamber through the second opening with a volume flow adequate to produce in the vacuum chamber a vacuum with respect to the environment, through which the pouch is opened, and d. moving the support with the opened pouch held thereon out of the vacuum chamber.

2. A method according to claim 1 wherein the pouch is held on at least one first lateral edge.

3. A method according to claim 2 wherein the pouch is displaceably held on a second lateral edge facing the first lateral edge so that opening is not impeded.

4. A method according to claim 3 wherein the support has a shell-like shape, which corresponds to a completely opened pouch.

5. A method according to claim 1 wherein the vacuum chamber is formed from two separable half-shells which receive the support between them.

6. A method according to claim 1 wherein the vacuum chamber is substantially cylindrical.

7. A method according to claim 1 wherein the first opening is in a first face of the vacuum chamber.

8. A method according to claim 7 wherein the second opening is in a vacuum chamber opposite to the first opening which faces the pouch opening zone.

9. A method according to claim 1 wherein the arrangement is such that on opening of the pouch the pouch engages on the edge of the first opening and substantially closes the latter.

10. Apparatus for opening prefabricated pouches, in which each pouch has a circumferential seal and an opening zone comprising:

a. at least one support for holding a pouch;

b. a vacuum chamber for receiving said support said vacuum chamber having a first opening facing said opening zone of said pouch and linked with the environment, and a second opening remote from said opening zone; and c. a suction device for producing a vacuum within said vacuum chamber, said suction device being connected to said second opening.

11. Apparatus according to claim 10 wherein said support has a first fixed clamping device for fixedly holding said pouch on a first lateral edge.

12. Apparatus according to claim 11 wherein said support has a second movable clamping device for the movable holding of said pouch on a second lateral edge.

13. Apparatus according to claim 10 wherein said support has a shell-like shape which corresponds to a completely opened pouch.

14. Apparatus according to claim 10 wherein said vacuum chamber is formed from a first and a second half-shell which are separable from one another and receive said support between them.

15. Apparatus according to claim 14 wherein at least one support and at least one first half-shell of said vacuum chamber are fitted to a first rotating conveyor and at least one second half-shell is fitted to a second rotating conveyor with said first conveyor and said second conveyor running adjacent to one another within an opening area so that within said opening area one of said first half-shell and one of said second half-shell form a vacuum chamber.

16. Apparatus according to claim 10 wherein said vacuum chamber is substantially cylindrical.

17. Apparatus according to claim 10 wherein said first opening is located in a first face of said vacuum chamber.

18. Apparatus according to claim 17 wherein said second opening is located in a second face of the vacuum chamber opposite to the first face.

19. Apparatus according to claim 10 wherein the arrangement is such that an opening pouch engages on an edge of said first opening and substantially closes the latter.

* * * * *